United States Patent [19]

Ellis et al.

[11] 4,400,314

[45] Aug. 23, 1983

[54] METHOD FOR THE ULTIMATE DISPOSAL OF HIGH LEVEL RADIOACTIVE WASTE

[75] Inventors: J. R. B. Ellis, Kentfield; Bernard A. Fries, Orinda, both of Calif.

[73] Assignee: Chevron Research Company, San Francisco, Calif.

[21] Appl. No.: 196,954

[22] Filed: Oct. 14, 1980

[51] Int. Cl.[3] ..... G21F 9/24

[52] U.S. Cl. ..... 252/633; 405/128

[58] Field of Search ..... 405/128; 252/631, 633

[56] References Cited

U.S. PATENT DOCUMENTS

| | | | |
|---|---|---|---|
| 3,108,439 | 10/1963 | Reynolds et al. | 405/128 |
| 3,236,053 | 2/1966 | Billue | 405/128 |
| 3,263,274 | 7/1966 | Nelson, Jr. | 405/128 |
| 3,379,013 | 4/1968 | Slagle et al. | 405/128 |
| 3,513,106 | 5/1970 | Stogner | 405/128 |

FOREIGN PATENT DOCUMENTS

| | | | |
|---|---|---|---|
| 2742340 | 3/1979 | Fed. Rep. of Germany | 405/128 |
| 140644 | 3/1980 | Fed. Rep. of Germany | 405/128 |
| 52-23872 | 2/1977 | Japan | 405/128 |

OTHER PUBLICATIONS

Nuclear Technology, vol. 43, Mid Apr., 1979, pp. 244–258.

Chemtech, Apr., 1980, pp. 211–214.

*Primary Examiner*—Brooks H. Hunt

*Attorney, Agent, or Firm*—D. A. Newell; S. R. La Paglia; W. D. Reese

[57] ABSTRACT

A method is disclosed for disposing of an aqueous solution of radioactive nuclides, in which the solution is diluted with formation water recovered from a subsea reservoir in a porous geological formation and, after dilution, the dilute solution is injected into the same subsea geological formation.

6 Claims, 1 Drawing Figure

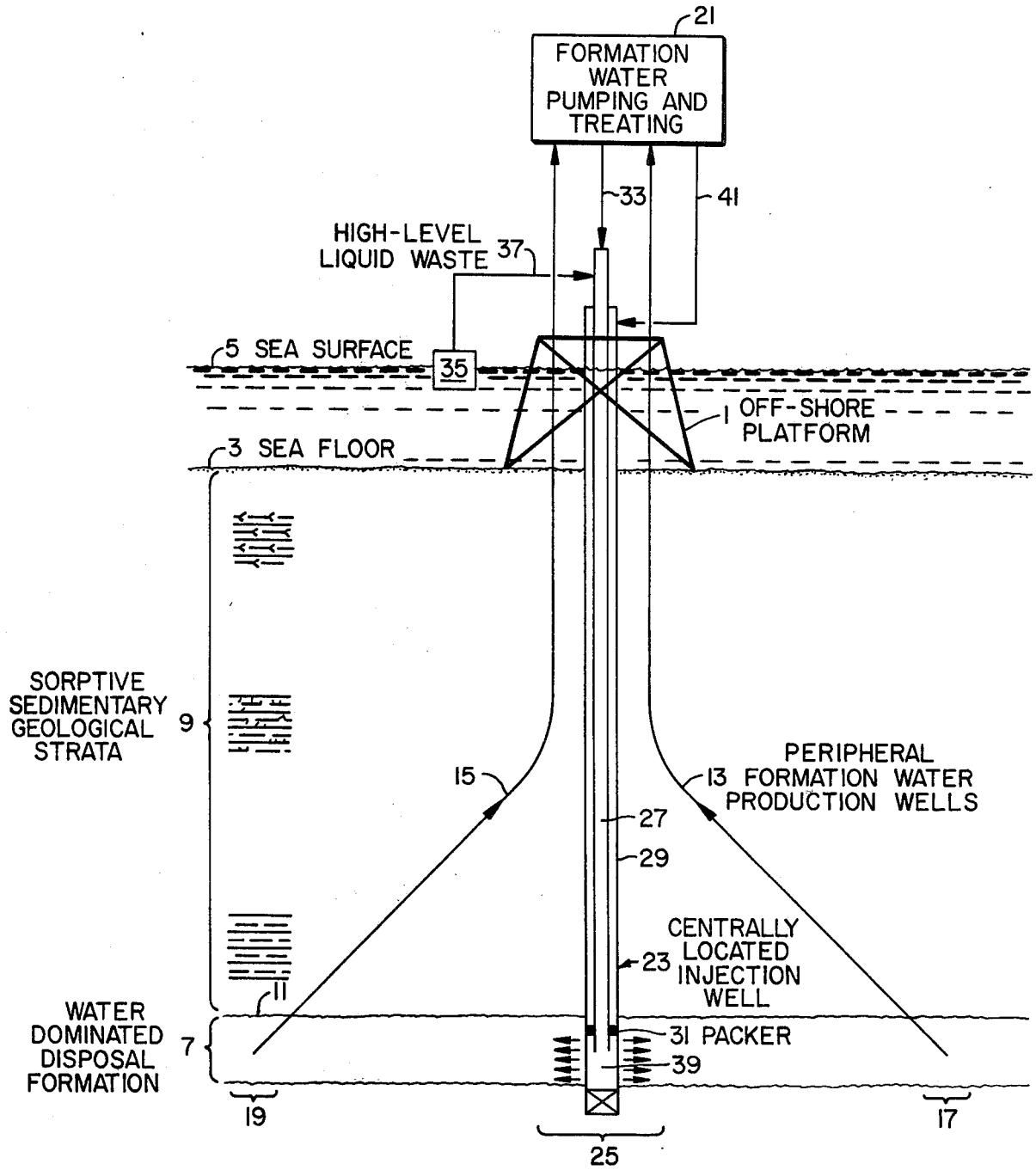
21
FORMATION WATER PUMPING AND TREATING
33
41
HIGH-LEVEL LIQUID WASTE
37
5 SEA SURFACE
35
1 OFF-SHORE PLATFORM
3 SEA FLOOR
SORPTIVE SEDIMENTARY GEOLOGICAL STRATA
9
15
13 PERIPHERAL FORMATION WATER PRODUCTION WELLS
27
29
CENTRALLY LOCATED INJECTION WELL
23
11
WATER DOMINATED DISPOSAL FORMATION
7
31 PACKER
39
19
25
17

METHOD FOR THE ULTIMATE DISPOSAL OF HIGH LEVEL RADIOACTIVE WASTE

BACKGROUND OF THE INVENTION

This invention concerns a method for disposing of radioactive waste. More specifically, this invention concerns a method for ultimate disposal of high level liquid waste by dilution and confinement.

Spent fuel from nuclear reactors can be reprocessed to recover uranium (and plutonium, if desired). The reprocessing operation generates a residue of radioactive waste. The radioactive waste formed in reprocessing may be divided into three types: (1) high-level liquid waste (HLLW)—aqueous waste that contains almost all (more than 99%) of the fission and actinide products with a small amount of uranium and plutonium not recovered during reprocessing; (2) intermediate-level liquid waste (ILLW)—aqueous waste which contains much lower concentrations of fission products than HLLW and contains no appreciable amounts of uranium or plutonium; and (3) low-level liquid waste (LLLW)—waste which requires only minimal treatment before release to the environment. Reprocessing of nuclear plant fuel is discussed in *Nuclear Technology,* Volume 43, pages 244–258, (mid-April, 1979), the disclosure of which is incorporated herein by specific reference.

Ultimate disposal of HLLW presents a difficult problem to the nuclear power industry, in that some of the radioactive species present in HLLW are very long-lived. The discussions of nuclear waste disposal in the following references are incorporated herein by specific reference: *Science,* Volume 197, Pages 519–527 (Aug. 5, 1979); *Oceanus,* Volume 20, No. 1 (Winter, 1977); *Nuclear Technology,* Volume 44, Pages 284–296 (July, 1979); *ERDA*-76-43, Volume 1–5 (May, 1976). As exemplified in the discussions in the above-listed references, current proposals for disposal of HLLW have been directed primarily to concentration and confinement of HLLW. The principal example of concentration and confinement techniques is the proposed system in which radioactive waste is incorporated into a borosilicate glass or similar solid form with low-water leachability properties. The solid is then further containerized and placed in a location (such as a geological formation) where the HLLW is expected to be undisturbed and out of contact with the biosphere for a very extended period. However, this system results in a concentrated source of radioactive nuclides, and their decay heat release, with the resultant high temperatures, having a detrimental effect on the surrounding geological formation and longevity of the containment and leachability properties of the solid waste form. Failure of the containment and solid waste form will then lead to the release of radioactive nuclides at a very high local concentration, greatly increasing the concentration gradient through the geological formations back to the biosphere. The present invention involves a method for disposing of radioactive waste, such as HLLW, which overcomes the disadvantages of concentration and confinement techniques.

SUMMARY OF THE INVENTION

The present invention concerns a method for disposing of radioactive waste such as HLLW which avoids disadvantages inherent in conventionally proposed techniques for concentration and confinement of HLLW. Instead, the present invention employs aqueous dilution of radioactive waste with water produced from a geological formation and confinement of the resultant dilute aqueous solution of the waste in the geological formation, preferably a deep formation in an offshore, subsea location. The invention provides unique benefits and advantages for ultimate disposal of HLLW, as discussed in detail below.

According to the invention, there is provided a method for disposing of an aqueous solution of radioactive nuclides, comprising: (a) producing water from a water-containing, porous, generally horizontally-extending, water-permeable geological formation located below sorptive sedimentary geological strata; (b) forming a dilute solution of the radioactive nuclides by mixing produced water with the aqueous solution; and (c) injecting the dilute solution into the geological formation.

Preferably, the geological formation selected for use in providing both water for dilution and an injection site for confining the dilute solution is located in a subsea area. Offshore disposal in a subsea geological formation permits disposal with substantial assurance that the disposed nuclides will not enter an aquifer from which water is withdrawn for surface use or from which there is a natural flow to on-shore, surface locations. Offshore geological disposal also ensures that any nuclides which migrate out of the formation used for disposal will be immediately further highly diluted by ocean water.

Preferably, the dilute solution of nuclides is injected into a centrally located injection site in the selected disposal formation, while formation water is simultaneously produced from a plurality of peripherally located production sites around the injection site. This insures that the dilute solution injected into the formation will be dispersed over a substantial horizontal cross-section of the formation and that the nuclides will be exposed to a substantial bed of sorptive solids to permit nuclide immobilization by substantial ion-exchange and chemisorption of nuclides.

BRIEF DESCRIPTION OF THE DRAWING

The attached drawing is a schematic illustration of a preferred embodiment of the present invention.

Referring to the drawing, there is shown an offshore platform 1. The platform is supported on the sea floor 3 and extends above the sea surface 5. The platform is disposed above a horizontally-extending geological formation 7. The formation 7 is porous and is horizontally permeable to water. The formation constitutes a reservoir for formation water. Sorptive sedimentary geological strata 9 extend between an upper boundary 11 of the formation 7 and the sea floor 3. Formation water is withdrawn from the formation 7 through a plurality of peripheral production wells, two of which are indicated at 13 and 15. The production wells draw water from producing regions, such as the regions 17 and 19 for the wells 13 and 15, respectively. The water produced from the wells 13 and 15 is passed into a pumping and treating system 21. One or more injection wells, such as a well 23, extend from the platform 1 to one or more injection sites, such as an injection region 25. The injection region 25 is located centrally in the formation 7 with respect to the producing regions 17 and 19 from which the peripheral producing wells draw water. The injection well 23 includes a central, primary injection conduit 27, used for injecting a dilute solution of radioactive nuclides and includes an annular space formed by a casing 29, and sealed at its bottom end by a packer 31. Most of the produced formation water, suitably treated if necessary, is passed from the treater 21 through a conduit 33 into the central injection conduit 27. A relatively concentrated aqueous solution of radioactive nuclides (HLLW) is conveyed to the platform 1 from a fuel reprocessing plant by transportation means, such as a specially constructed sea-going barge 35, or by other suitable conventional conveying means. The HLLW is pumped through a conduit 37 from the barge 35 into the injection conduit 27 and is diluted in the conduit 27 with the treated formation water. The resulting dilute solution is passed downwardly through conduit 27 into a perforated Section 39 of the casing 29 and injected into the formation 7. Sufficient treated formation water is passed from the treatment system 21 through a conduit 41 into the annulus in the casing 29 to maintain pressure in the annulus higher than the pressure in conduit 27. This insures that any leakage or communication between conduit 27 and the annulus will not result in a discharge of radioactive nuclides into the annulus. By producing formation water from the peripheral producing regions 17 and 19 while injecting a dilute solution of radioactive nuclides into the central injection region 25, the radioactive nuclides injected into formation 7 are thereby dispersed horizontally in the formation toward the peripheral wells.

DETAILED DESCRIPTION OF THE INVENTION

The present invention provides a means for the disposal of aqueous HLLW solutions and similar solutions containing radioactive nuclides, such as fission products and actinide ions. HLLW is typically provided as an acidic aqueous solution, e.g., a nitric acid solution derived from spent nuclear fuel reprocessing. Other aqueous solutions of radioactive nuclides, for example, solutions containing other acids or other solubilizing agents, are suitable for disposal by the method of the present invention.

According to the invention, HLLW, or a similar relatively highly concentrated solution of radioactive nuclides in terms of specific radioactivity (expressed in $Ci/m^3$), is substantially diluted, (approximately 100-fold dilution is generally suitable for HLLW) with formation water withdrawn from a selected, preferably subsea geological formation. By the term "formation water", is meant any aqueous liquid present in the selected geological formation. The water present in the formation may be naturally occurring or may be artifically introduced. For example, mobile connate water is suitable, and water introduced for, e.g., secondary recovery of petroleum is also suitable. If the selected formation includes petroleum, it is within the scope of the invention to produce a mixture of petroleum and formation water and to recover the petroleum until the first appearance of radio-nuclides at the producing well. This may permit further oil recovery after floodout in normal secondary recovery. Provision is made to treat the produced formation water, as by filtration, bacteria removal, pH adjustment, ion exchange or the addition of other agents, prior to mixing with the HLLW. Treatment may suitably be carried out according to conventional techniques used for treating water used in flooding for secondary oil recovery, with the additional requirement of preventing precipitation of any of the radioactive nuclides upon mixing of HLLW and formation water. A major advantage of dilution of HLLW with large amounts of water is that it substantially reduces the concentration of the radioactive nuclides ($Ci/m^3$), and thus reduces the radioactive decay heat content ($KW/m^3$) of the HLLW prior to disposal in the geological formation. The exact extent of the dilution of HLLW with formation water is not critical to the invention. Preferably, the dilution is sufficient to decrease the concentration of iodine-129 in the resulting dilute solution to its maximum permissible concentration (MPC) in microcuries per milliliter (uCi/ml) in soluble form above natural background in water in unrestricted areas, i.e., equivalent to potable water. The MPC for I-129 is specified by the U.S. Nuclear Regulatory Commission (Title 10, 10 CFR 20, Appendix B).

Iodine-129 has the longest half-life (16 million years) of all the fission product and actinide elements conventionally found in highly radioactive wastes, such as HLLW. I-129 is considered the most mobile of all the radioactive nuclides with respect to transport through geological strata, since it is present only in anionic form and therefore least subject to chemisorption and ion exchange in such strata. If the HLLW to be disposed of is diluted to the MPC for I-129 prior to disposal, even if iodine-129 eventually migrates from the porous formation in which it has been confined into other geological strata where it might encounter other water flows (or directly into the ocean), it would be released to such flows at a concentration equal to or below its MPC.

The amount of dilution selected to reduce the I-129 concentration may advantageously be sufficient to bring some of the other long-lived radioactive nuclides to concentrations below their respective MPC's, while still others would have concentrations exceeding their MPC's. However, all these other radioactive nuclides have very high probabilities of immobilization by ion exchange and chemisorption in geological media. It is expected that all radioactive nuclides injected into the selected confinement formation will remain within the formation but should any nuclides other than iodine-129 migrate they will be immobilized by sorption within a large thickness of sedimentary geological strata overlying the formation into which the nuclides are injected.

The diluted solution of nuclides resulting from the mixing of HLLW and formation water is injected into a suitable, preferably subsea, geological formation. A formation must have several properties in order to be suitable for selection as a disposal site in carrying out this invention. The formation selected must contain the necessary amount of mobile water. It must be horizontally-extending for distances of the order of thousands of meters. The combination of horizontal extent, vertical extent and porosity must be such as to provide a formation having a volume sufficient to permit a practical quantity of dilute radioactive solution to be injected and to provide a practical quantity of formation water for the purpose of diluting the initially concentrated HLLW. Typical suitable values of vertical extent are 5 to 10 meters or more; typical suitable values of porosity are 10 to 20% or more. Additionally, the formation must have a substantial horizontally permeability to water to permit the ready withdrawal of formation water for the purpose of dilution from a limited number of peripheral producing wells and ready acceptance of the diluted radioactive waste solution at a reasonable pressure and flow rate into one or a few centrally located injection wells.

The upper boundary of a suitable geological formation used for the disposal of the radioactive nuclides must lie hundreds to thousands of meters beneath the surface, which is preferably the sea floor above it. The intervening overburden comprises various geological strata. Typically, some strata will be substantially water impermeable, and other strata will be highly sorptive, as is the case with sedimentary deposits. A preferred geological formation for disposal of the nuclides may be, for example, a depleted or partially-depleted, water-dominated petroleum reservoir.

The formation water employed for diluting the solution of radioactive nuclides is produced from at least one production site, or region, in the disposal formation. Producing sites are generally horizontally spaced from the injection site of the radioactive nuclides. Preferably, formation water is produced from a plurality of producing sites horizontally-spaced peripherally around the injection site. Preferably, at least 4–10 peripheral production wells should be employed for each injection well. By producing the formation water peripherally, uniform radial dispersion of the dilute solution of radioactive nuclides is enhanced.

The following Preferred Embodiment illustrates a preferred mode for carrying out the present invention and is not intended to constitute a limitation on the scope of the invention, which, as will be apparent to those skilled in the art, includes numerous variations, equivalents and modifications of the depicted embodiment.

PREFERRED EMBODIMENT

A preferred embodiment of the invention can best be further described by reference to the attached drawing to illustrate a system adapted for disposal of the high-level liquid waste (HLLW) from a nuclear fuel reprocessing plant having a capacity to reprocess 10 metric tons of heavy metal (uranium, plutonium) per day (10 MTHM/Day) for 300 days per calendar year over an injection period of 10 years. (This is the equivalent of the nuclear fuel reprocessing requirements for approximately sixty-six 1000 MWe nuclear power plants, which is about equivalent to the capacity of all currently operating nuclear power plants in the United States. The expected volumetric rate of HLLW generated by reprocessing 10 MTHM/Day of spent nuclear fuel, in accordance with the preferred embodiment of this invention, is about 61.5 $m^3$/Day, consisting of about 60 $m^3$/Day of unconcentrated high activity waste and about 1.5 $m^3$/Day of concentrated low activity waste. This HLLW releases up to 1.31 KW/$m^3$ of radioactive decay heat (1.4 years away from reactor). According to the invention, the HLLW is diluted 100-fold by mixing with 6150 $m^3$/Day of produced formation water, treated, if necessary, to assure that precipitates of the radioactive nuclides will not be formed on mixing. Based on previous seismic and other exploratory determinations, including sampling of formation strata and fluids, platform 1 is set in an offshore location. The central injection well 23 is drilled with careful recovery of formation cores and fluids to identify the depth and vertical extent of potentially desirable injection formations.

The preferred formation 7 will be at a depth of, e.g., 1600 meters below the sea floor, with a vertical extent of about 8 meters, a porosity of about 25%, and a horizontal water permeability of at least 200 millidarcies. Casing 29 is installed in well 23 to a depth just below the bottom of the formation 7. The casing 29 is perforated over the vertical height of the formation 7 (at perforated section 39). The natural hydrologic rate and direction of flow through the perforations are measured to verify that formation 7 is not a part of an active aquifer. Then peripheral production wells, two of which are indicated at 13 and 15, are directionally drilled from platform 1 to intersect formation 7 at a radial distance from the injection site at producing sites 17 and 19. The radial distance is selected to provide a pore volume in formation 7 equivalent to the volume of the HLLW plus the volume of formation water used for dilution for the expected 10 year (3000 day) length of the injection period, preferably with an additional 20% to compensate for incomplete sweep and displacement efficiency. For example, if the formation 7 has a vertical height of 8 meters and a porosity of 25%, the radial distance from the central injection site to the peripheral producing sites would equal about 1890 meters. The ten peripheral production wells are cased and suitable pumping means installed to produce 615 $m^3$/Day of formation water from each production well. The formation water is treated, if necessary, in treater 21 and then passed into injection conduit 27, through conduit 33 except for flow as needed through conduit 41 into the annulus within casing 29 to maintain higher pressure. If it is found that complete formation water recycle through injection well 23 cannot be maintained at the desired rate, additional injection wells, centrally located and otherwise identical to injection well 23, may suitably be employed. After an adequate formation water flow rate is established in the injection conduit 27, the HLLW can be introduced into this stream through conduit 37. The dilute solution passes through perforations in the section 39, moves radially through formation 7 toward locations 17 and 19, and is dispersed within formation 7. The estimated increase in temperature of formation 7 near the injection site by the end of the ten-year injection period is not expected to exceed 90° C.

The output from the producing wells is monitored with conventional radioactivity indicators. If breakthrough of radioactivity from the injection site to any of the producing wells is indicated, that well is cemented in.

A preferred embodiment having been described, the equivalents and modifications of the invention, which will be apparent to those skilled in the art, are included within the scope of the appended claims.

We claim:

1. A method for disposing of an aqueous solution of radioactive nuclides, comprising:

(a) producing water from a water-containing, porous, generally horizontally-extending, water-permeable geological formation located below sorptive sedimentary geological strata;

(b) forming a dilute solution of said nuclides by mixing produced water with said aqueous solution; and (c) injecting said dilute solution into said formation.

2. A method according to claim 1 wherein said formation is a subsea formation.

3. A method according to claim 2 wherein the upper boundary of said formation is located at least 1,600 meters below the sea floor.

4. A method according to claim 1 wherein said formation comprises a partially or wholly depleted petroleum reservoir.

5. A method according to claim 4 wherein petroleum is produced from said formation in a mixture with said formation water and separated from said formation water.

6. A method according to claim 1 wherein formation water is produced from a plurality of producing sites in said formation, said producing sites being horizontally spaced generally peripherally around an injection site, and said dilute solution is injected into said injection site.

* * * * *